US007360882B2

(12) United States Patent
Ikeda et al.

(10) Patent No.: US 7,360,882 B2
(45) Date of Patent: Apr. 22, 2008

(54) INK-JET RECORDING APPARATUS, METHOD OF REMOVING AIR OF INK-JET RECORDING APPARATUS AND REMOVING AIR DEVICE

(75) Inventors: Takahisa Ikeda, Mishima (JP); Atsushi Kubota, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 356 days.

(21) Appl. No.: 11/113,402

(22) Filed: Apr. 22, 2005

(65) Prior Publication Data

US 2006/0284948 A1 Dec. 21, 2006

(51) Int. Cl.
*B41J 2/19* (2006.01)
*B41J 2/175* (2006.01)
*B41J 29/38* (2006.01)

(52) U.S. Cl. ..... 347/92; 347/85; 347/6

(58) Field of Classification Search ..... 347/92, 347/93, 84–87, 6
See application file for complete search history.

(56) References Cited

U.S. PATENT DOCUMENTS 4,995,940 A 2/1991 Hine et al.
5,341,162 A 8/1994 Hermanson et al.
5,557,305 A 9/1996 Hine et al.
5,659,346 A 8/1997 Moynihan et al.
6,213,596 B1 * 4/2001 Nowell et al. ..... 347/85
2004/0100541 A1 5/2004 Ikeda

FOREIGN PATENT DOCUMENTS

JP 403180355 A * 8/1991 ..... 347/92
JP 11-027452 A 1/1999
JP 11-48493 A 2/1999
JP 11-114309 A 4/1999

* cited by examiner

*Primary Examiner*—Shih-wen Hsieh
(74) *Attorney, Agent, or Firm*—Frishauf, Holtz, Goodman & Chick, P.C.

(57) ABSTRACT

An air removing device is connected to a tank to contain ink through a first supply tube, and an ink-jet head is connected to the air removing device through a second supply tube. The first supply tube and ink-jet head are heated and controlled. Air dissolved in ink is sucked out through a hollow fiber membrane provided in a housing by operating a vacuum pump by supplying ink to the hollow fiber membrane while heating and controlling atmosphere in the housing. Thus, air dissolved in ink is removed, and ink heated to a temperature suitable for ejection is supplied to the ink-jet head.

12 Claims, 2 Drawing Sheets

INK-JET RECORDING APPARATUS, METHOD OF REMOVING AIR OF INK-JET RECORDING APPARATUS AND REMOVING AIR DEVICE

BACKGROUND OF THE INVENTION

1. Field of the Invention

The present invention relates to an ink-jet recording apparatus which supplies an ink-jet head with ink while removing air dissolved in ink not to affect ejection of ink, a method of removing air of an ink-jet recording apparatus, and an air removing device.

2. Description of the Related Art

A conventional ink-jet recording apparatus pressurizes ink in a pressure chamber and ejects ink as an ink drop. An ejected ink drop is adhered to a recording medium at a certain distance from an ink jet head. As a result, an image is formed.

When a nozzle is clogged or an air bubble is generated in a pressure chamber, ink may not be ejected from a nozzle. If ink is not ejected from a nozzle, printing on a recording medium fails.

A filter is provided before an ink-jet head to remove dust mixed in ink and causes clogging of a nozzle.

When an air bubble is generated in a pressure chamber, an ink pressurizing force is lowered. As a result, an ink drop ejecting force is lowered. Thus, it is necessary to remove air dissolved in the ink supplied to the ink-jet head.

Air removing device and method are proposed to remove air dissolved in ink.

For example, U.S. Pat. No. 5,341,162 proposes a device for removing air dissolved in liquid by heating liquid.

Jpn. Pat. Appln. KOKAI Publication No. 11-114309 proposes a method of heating a tube connected to an air removing device and guiding the heated liquid to the air removing device.

The device of U.S. Pat. No. 5,341,162 increases an air removing capacity by heating, but releases dissolved air into the atmosphere. Thus, an air removing efficiency is bad compared with an enclosed type air removing device.

A heating means such as a heater is placed directly in liquid in this device.

This configuration makes maintenance of a heating means troublesome.

The device of Jpn. Pat. Appln. KOKAI Publication No. 11-114309 increases an air removing capacity by guiding heated liquid to an air removing device. But, the liquid ejected from the air removing device is cooled down to a previous temperature in the next process. Generally, solubility of air in liquid decreases when a temperature increases, and increases when a temperature decreases.

Thus, when the liquid ejected from the air removing device is cooled, air dissolves in liquid and the amount of dissolved air increases.

BRIEF SUMMARY OF THE INVENTION

It is an object of the present invention to provide an ink-jet recording apparatus, which supplies an ink-jet head with ink while removing air dissolved in ink not to affect ejection of ink, a method of removing air of an ink-jet recording apparatus, and an air removing device.

According to an aspect of the present invention, there is provided an ink-jet recording apparatus comprising a tank configured to contain ink; an air removing device configured to connect to the tank through a first supply tube; an ink-jet head configured to connect to the air removing device through a second supply tube; and a heating member configured to heat the first supply tube and ink-jet head, wherein the air removing device has a housing, a hollow fiber membrane provided in the housing, a heating part configured to heat atmosphere in the housing to a predetermined temperature, and a vacuum pump configured to suck out air dissolved in ink through the hollow fiber membrane while supplying ink to a path formed by the hollow fiber membrane.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
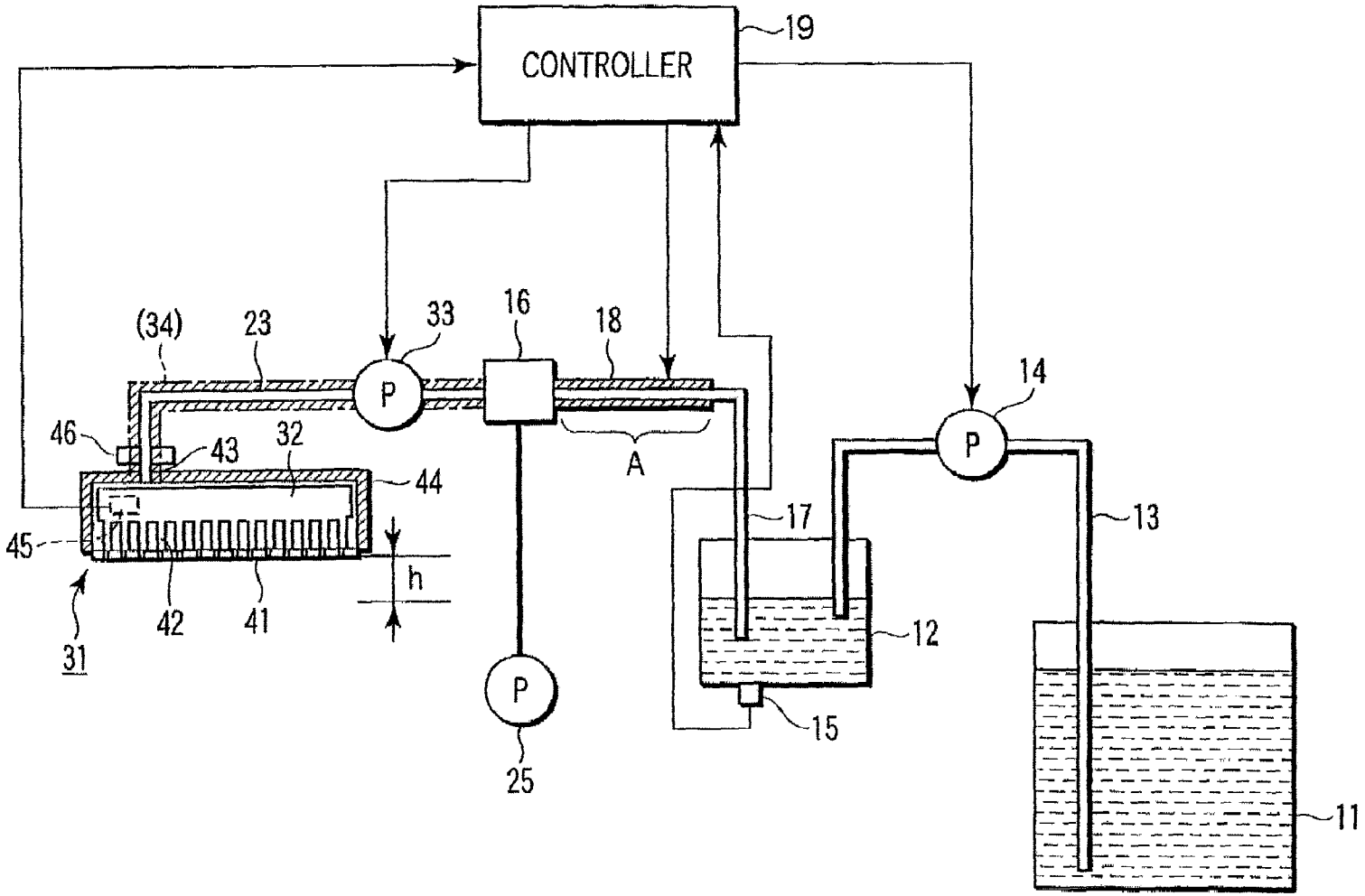
FIG. 1 shows the whole structure of an ink-jet recording apparatus according to an embodiment of the present invention.

An embodiment of the present invention will be explained hereinafter with reference to the accompanying drawings. An ink-jet recording apparatus will be explained with reference to FIG. 1. In FIG. 1, a reference numeral 11 denotes a main tank to contain ink. An ink supply tube 13 is connected between the main tank 11 and a subtank 12 to contain ink. An ink supply pump 14 is provided in the ink supply tube 13. The amount of ink in the sub-tank 12 is detected by a weight sensor 15. The amount of ink in the sub-tank 12 detected by the weight sensor 15 is sent to a control unit (CONTROLLER) 19. When the amount of ink in the sub-tank 12 detected by the weight sensor 15 becomes lower than a predetermined value, the ink supply pump 14 is driven to supply ink from the main tank 11 to the subtank 12.

An ink supply tube (a first supply tube) 17 is provided between the sub-tank 12 and an air removing device 16. The air removing device 16 will be explained in detail later with reference to FIG. 2. A heater 18 is provided around the periphery of the ink supply tube 17 placed just before the air removing device 16. The temperature of the heater 18 is controlled by the control unit 19. The temperature of ink is controlled by the heater 18, so that the viscosity of the ink supplied to the air removing device 16 becomes 6-11 cps. For example, the temperature of the ink heated by the heater 18 is assumed to be higher than an optimum temperature Ta described later.

Figure 2:
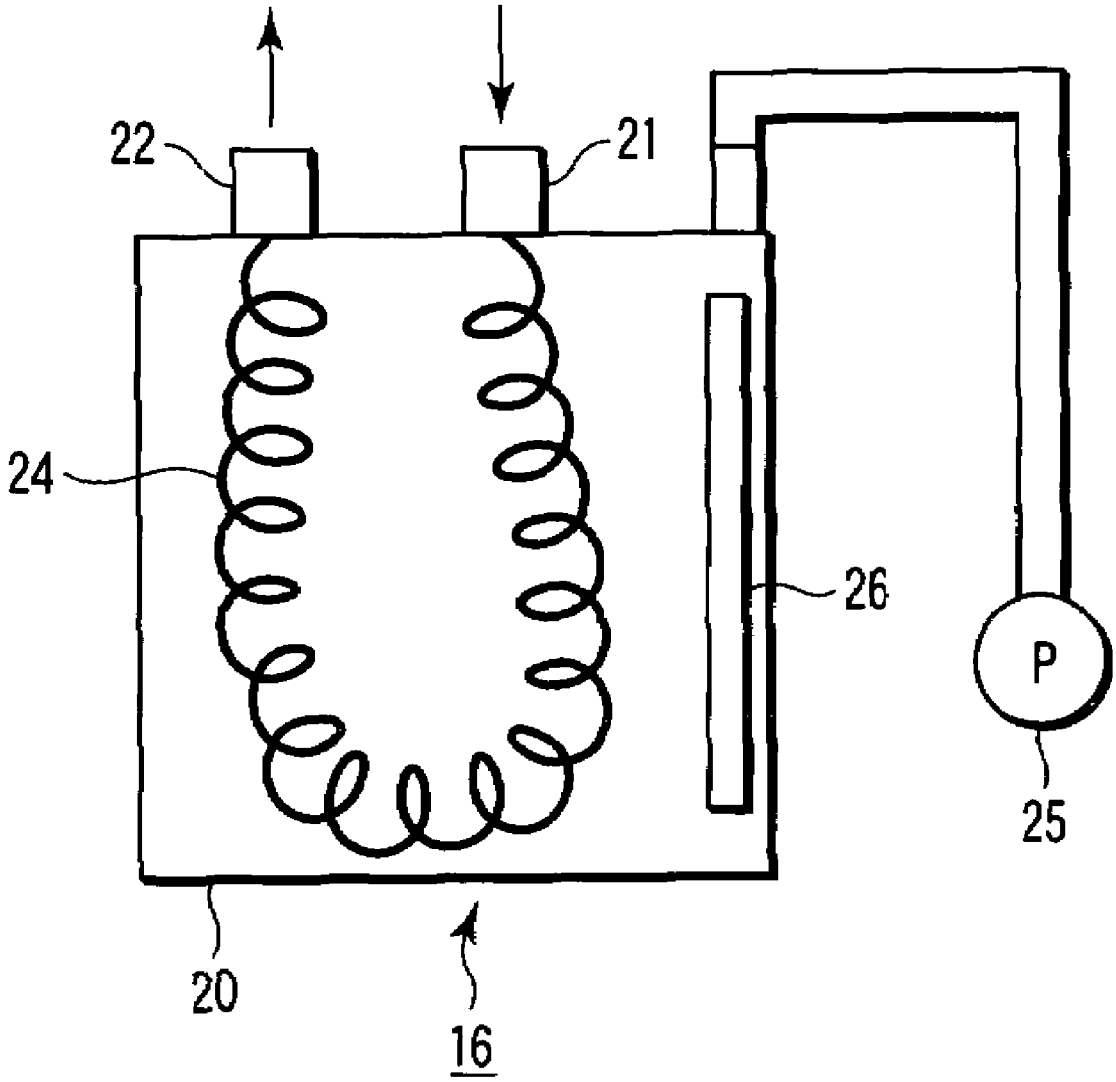
FIG. 2 shows the configuration of an air removing device according to the same embodiment.

Next, the configuration of the air removing device 16 will be explained in detail with reference to FIG. 2. In FIG. 2, a reference numeral 21 denotes an ink takein port provided in a housing 20, and 22 denotes an ink takeout port provided in the housing 20 of the air removing device 16. One end of the ink supply tube 17 is connected to the ink take-in port 21. One end of the ink supply tube (a second supply tube) 23 is connected to the ink take-out port 22. A bundle of hollow fiber membrane 24 having air transmissivity is provided between the ink takein port 21 and ink take-out port 22.

A suction port of a vacuum pump 25 is connected to the housing 20. The vacuum pump 25 keeps the air removing device 16 vacuum. The vacuum pump 25 sucks out the air dissolved in ink to the outside of the hollow fiber membrane 24 through the hollow fiber membrane 24.

A far-infrared heater 26 is provided in the housing 20. The control unit 19 controls the temperature in the housing 20 heated by the far-infrared heater 26. The temperature in the housing 20 is almost equal to the temperature of the ink flowing in the hollow fiber membrane 24, and the farinfrared heater 26 keeps the temperature of the ink flowing in the hollow fiber membrane 24 in the housing 20 at an optimum ejection temperature Ta. The optimum ejection temperature Ta mentioned here means a temperature suitable for keeping the viscosity of ink filled in a common ink chamber 32 described later at 6-11 cps. For example, a temperature of 40° C. is set as an optimum temperature Ta.

The reason why the far-infrared heater 26 is used is that the ink flowing in the hollow fiber membrane 24 can be heated even in vacuum.

As for the relation between a temperature of ink and dissolved air, saturation solubility decreases when a temperature increases. Namely, when a temperature of ink is high, the amount of air dissolved in ink decreases. Thus, ink with less dissolved air is taken in the air removing device 16 by heating ink with the heater 18 before taking ink into the air removing device 16. If the air removing capacity of the air removing device 16 is constant, dissolved air can be effectively removed when a temperature of ink is high.

Now, a relation between a pressure of ink and air will be explained. When a pressure of ink is high, air is easy to dissolve. When a pressure of ink is low, air dissolved in ink is released to the atmosphere as air. As one end of the thin hollow fiber membrane 24 is connected to the ink take-in port 21 of the air removing device 16, a pressure of ink increases when ink flows into the hollow fiber membrane 24 through the ink take-in port 21.

On the other hand, as the tube diameter is thick at the ink take-out port 22 of the air removing device 16, a pressure of ink decreases.

Ink is heated by the heater 18 before taken into the air removing device 16, thereby the ink viscosity is lowered and the ink is smooth flowed in the hollow fiber membrane 24. This prevents increasing/decreasing of ink pressure at the ink take-in port 21 and ink take-out port 22.

The other end of the ink supply tube 23 connected to the ink take-out port 22 of the air removing device 16 is connected to the common ink chamber 32 of an ink-jet head 31. An ink supply pump 33 is provided in the ink supply tube 23. When the ink supply pump 33 is driven, ink is taken out from the air removing device 16 and sent to the common ink chamber 32.

A temperature of the ink supplied to the common ink chamber 32 is preferably a little Tb lower than the optimum temperature Ta. Heat is generated when the ink-jet head 31 is driven. Thus, a temperature of the ink supplied to the common ink chamber 32 of the ink-jet head 31 increases. If a temperature of the ink supplied to the common ink chamber 32 is the optimum temperature Ta, when the ink-jet 31 is driven, a temperature of ink is actually increased to Ta+Tb. Tb mentioned here is an average temperature increase value accompanying with ejection, and 5° C. for example. When a temperature of the ink in the common chamber 32 increases over the optimum temperature Ta, ejection of ink becomes unstable.

The sub-tank 12 is opened to the atmosphere. A negative pressure acts on the ink in a nozzle of the ink-jet head 31 by utilizing a height difference h between the surface of the ink stored in the sub-tank and the nozzle of the ink-jet head 31. The negative pressure prevents leakage of ink from the nozzle.

The ink-jet head 31 is provided with a nozzle plate 41 with nozzles formed on a straight line, pressure chambers 42 connecting with the nozzles, a common ink chamber 32 connecting with the pressure chambers 42, an ink supply port 43 to supply ink to the common ink chamber 32, and a heater 44 to heat the ink in the common chamber 32. On the base plate in the ink-jet head 31, a temperature sensor 45 is provided to detect a temperature of the ink in the common ink chamber 32. A reference numeral 46 denotes a filter for eliminating impurities from the ink supplied from the ink supply tube 23 to the common ink chamber 32.

A temperature of the heater 44 is controlled with the control unit 19. Namely, the temperature in the common ink chamber 32 is kept at TaTb by controlling the heater 44.

As described above, the ink-jet head 31 is configured to eject the ink supplied from the ink supply port 43 and filled in the pressure chambers 42 through the common ink chamber 32, as an ink drop from each nozzle. The outside surface of the nozzle plate 41 functions as a nozzle surface.

A reference numeral 51 denotes a recording medium transfer part, which sequentially feeds a recording medium to the position opposite to the nozzle of the ink-jet head 31 and transfers the recording medium in the sub-scanning direction.

The ink supplied to the air removing device 16 can be heated by heating the ink supply tube 17 provided in the upstream side of the air removing device 16 with the heater 18. As a result, the viscosity of ink supplied to the air removing device 16 can be lowered and the ink can be flowed smooth in the hollow fiber membrane 24.

Ejection of ink can be stabilized by keeping a temperature of the ink supplied from the heater 44 of the ink-jet heat 31 to the common ink chamber 32 at a value of Tb lower than the optimum temperature Ta.

The embodiment of the invention uses a piezoelectric ink-jet head using a piezoelectric element. An ink-jet head is not limited to this. For example, a thermal ink-jet head using a heating element can be used.

When a temperature of the ink decreases lower than Ta−Tb before the ink is supplied to the common ink chamber 32 through the ink supply tube 23 in a certain circumstance of using the ink-jet head 31, it is permitted to control a temperature of ink not to become lower than Ta−Tb by attaching the heater 34 around the periphery of the ink supply tube 23 as indicated by a chain line.

In the above-mentioned embodiment, the amount of ink in the sub-tank 12 is detected by the weight sensor 15. But, it is permitted to detect by using a liquid level sensor.

In the above-mentioned embodiment, it is permitted to provide a temperature sensor necessary to control temperatures of the heater 18 and far-infrared heater 26.

In the above-mentioned embodiment, ink is heated by the heaters 18 and 44, but it is permitted to use a warm water pipe instead of the heaters.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet recording apparatus comprising:

a tank configured to contain ink;

an air removing device configured to connect to the tank through a first supply tube;

an ink-jet head configured to connect to the air removing device through a second supply tube; and a heating member configured to heat the first supply tube and the ink-jet head, wherein the air removing device comprises: a housing, a hollow fiber membrane provided in the housing, a heating part configured to heat ink in a path formed by the hollow fiber membrane to a predetermined temperature, and a vacuum pump configured to suck out air dissolved in the ink through the hollow fiber membrane while supplying the ink through the path formed by the hollow fiber membrane.

2. The ink-jet recording apparatus according to claim 1, wherein the predetermined temperature is an optimum ejection temperature Ta of ink suitable for ejection from the ink-jet head.

3. The ink-jet recording apparatus according to claim 2, wherein a temperature of the heating part is lower than a temperature of the heating member to heat the first supply tube and higher than a temperature of the second supply tube.

4. The ink-jet recording apparatus according to claim 2, further comprising a heating member provided around a periphery of the second supply tube, wherein a temperature of the heating member around the second supply tube is controlled so as not to decrease a temperature of the ink supplied through the second supply tube to lower than Ta−Tb.

5. The ink-jet recording apparatus according to claim 4, wherein Tb is an average temperature increase of ink accompanying ejection by the ink-jet head.

6. The ink-jet recording apparatus according to claim 1, wherein the heating member configured to heat the first supply tube and the ink-jet head comprises a first heater to heat the first supply tube and a second heater to heat the ink-jet head.

7. An ink-jet recording apparatus comprising:

a tank configured to contain ink;

air removing means for removing air from the ink, the air removing means being connected to the tank through a first supply tube;

ink-jet means for jetting ink, the ink jet means being connected to the air removing means through a second supply tube; and heating means for heating the first supply tube and the ink-jet means, wherein the air removing means comprises: a housing, a hollow fiber membrane provided in the housing, a heating part configured to ink in a path formed by the hollow fiber membrane to a predetermined temperature, and a vacuum pump configured to suck out air dissolved in the ink through the hollow fiber membrane while supplying the ink through the path formed by the hollow fiber membrane.

8. The ink-jet recording apparatus according to claim 7, wherein the predetermined temperature is an optimum ejection temperature Ta of ink suitable for ejection from an ink-jet head.

9. The ink-jet recording apparatus according to claim 7, wherein a temperature of the heating part is lower than a temperature of the heating means to heat the first supply tube and higher than a temperature of the second supply tube.

10. The ink-jet recording apparatus according to claim 7, further comprising heating means provided around a periphery of the second supply tube, wherein a temperature of the heating means around the second supply tube is controlled so as not to decrease a temperature of the ink supplied through the second supply tube to lower than Ta−Tb.

11. The ink-jet recording apparatus according to claim 10, wherein Tb is an average temperature increase of ink accompanying ejection by the ink-jet means.

12. The ink-jet recording apparatus according to claim 7, wherein the heating means for heating the first supply tube and the ink-jet head comprises a first heater to heat the first supply tube and a second heater to ink the ink-jet head.

* * * * *